US006839535B2

(12) United States Patent
Sugiyama

(10) Patent No.: US 6,839,535 B2
(45) Date of Patent: Jan. 4, 2005

(54) DEVELOPING APPARATUS

(75) Inventor: Shinichi Sugiyama, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/414,229

(22) Filed: Apr. 16, 2003

(65) Prior Publication Data

US 2003/0198490 A1 Oct. 23, 2003

(30) Foreign Application Priority Data

Apr. 17, 2002 (JP) ..... 2002-114627

(51) Int. Cl.[7] ..... G03G 15/08; G03G 15/09

(52) U.S. Cl. ..... 399/269; 399/167; 399/228; 399/281

(58) Field of Search ..... 399/119, 228, 399/269, 281, 282, 286

(56) References Cited

U.S. PATENT DOCUMENTS 3,953,121 A 4/1976 Reichart, Jr. ..... 355/119
5,471,286 A * 11/1995 Tanaka ..... 399/167
6,694,118 B2 * 2/2004 Yoo ..... 399/228
2002/0041778 A1 4/2002 Muto et al. ..... 399/281

FOREIGN PATENT DOCUMENTS

EP 0 907 115 A2 4/2001
EP 1 126 330 A2 8/2001
EP 1 162 515 A2 12/2001
EP 1184737 * 3/2002

* cited by examiner

*Primary Examiner*—D. Rutledge
(74) *Attorney, Agent, or Firm*—Fitzpatrick, Cella, Harper & Scinto

(57) ABSTRACT

The present invention relates to a developing apparatus comprisinga developing container for containing a developing agent and rotatable first and second developing members provided at the developing container as to face an image carrier for developing an electrostatic image formed on the image carrier. The first developing member is secured to the developing container to keep a gap to the image carrier and the second developing member has keeping members at both ends in a longitudinal direction thereof to keep a gap to the image carrier.

7 Claims, 11 Drawing Sheets

DEVELOPING APPARATUS

BACKGROUND OF THE INVENTION

1. Field of the Invention

This invention relates to a developing apparatus for photocopiers, printers, facsimile machines, and the like which uses one of an electrophotographic method, an electrostatic recording method, and the like.

2. Description of Related Art

FIG. 9 is a cross section showing a schematic structure of a conventional image forming section. In the image forming section such as a photocopier shown in FIG. 9, a photosensitive body 101 as an image carrier is charged with a charging apparatus 102, and an electrostatic latent image is formed on a circumferential surface of the photosensitive body 101 by exposing images of the original document at an exposure position 103 with an exposure optical system. The electrostatic latent image formed on a circumferential surface of the photosensitive body is developed by a developing apparatus 109 to form a toner image, and the toner image is transferred onto a transfer material in application of a voltage at a transfer apparatus 104. After the photosensitive body 101 to which the transfer is made is cleaned by a cleaning apparatus 106, remaining charges are removed upon exposure before charging, and the above steps are repeated to form images.

The developing apparatus 109 is disposed with a developer carrier 111 (hereinafter referred to as "developing sleeve") arranged with a certain gap with respect to the photosensitive body 101. A means for restricting the gap is defined by the difference between the outer diameter of a restricting member 118 (striking roller) rotating around the same shaft of the developing sleeve 111 and the outer diameter of the developing sleeve 111, and generally adapts the striking roller method guaranteeing the gap by pushing the developing sleeve 111 toward the photosensitive body 101.

According to a recent tendency of higher copying and printing speeds, there is a developing apparatus having two developing sleeves corresponding to a high speed. FIG. 10 is a schematic cross section showing a developing apparatus of a conventional example having two developing sleeves. With this developing apparatus, a developing sleeve 111*a* (hereinafter referred to as "developing upper sleeve") as a first developing member located on an upstream side in an image forming process and a developing sleeve 111*b* (hereinafter referred to as "developing lower sleeve") as a second developing member located on a downstream side are rotatively arranged at respective shafts of the developing apparatus.

The photosensitive body 101 may be subject to vibrations occurring during rotation due to size accuracy, and the rotation of the photosensitive body 101 may be disturbed if the developing apparatus 109 is secured under a state that the striking rollers 121*a*, 121*b* are in contact with the surface of the photosensitive body 101. The apparatus is structured in which elastic force of an elastic member such as a spring or the like absorbs the vibrations of the photosensitive body 101 by pushing a developing container 110 of the developing apparatus 109 toward the photosensitive body 101 via the elastic member 131 to absorb the vibrations of the photosensitive body 101.

FIG. 11 is a schematic cross section showing a developing apparatus of a second conventional example having two developing sleeves. In this conventional example, an apparatus is devised in which the developing upper sleeve 111*a* is rotatively supported to the developing container 110, in which the developing lower sleeve 111*b* is rotatively supported via a pair of independent rocking members 141, 141 whose rocking center coincides to the shaft supporting the developing upper sleeve on the opposite sides, and in which the rocking members are pushed to the photosensitive body 101 by an elastic member 151.

In the conventional developing apparatus having a sole developing sleeve, the gap between the developing sleeve 111 and the photosensitive body 101 is arranged with high accuracy in a limited range from a variety of viewpoints. This is substantially the same as the developing apparatus 109 capable high speed having two developing sleeve 111, and guaranteeing of gaps with high accuracy is needed at the gap between the developing upper sleeve 111*a* and the photosensitive body, the gap between the developing lower sleeve 111*b* and the photosensitive body 101, and the gap between the developing upper sleeve 111*a* and the developing lower sleeve 111*b*.

The first conventional example in which plural developing sleeves 111 are secured between shafts in the same developing container, raises the following problems.

When the striking rollers 121*a*, 121*b* on the same shaft of the developing sleeve come in contact with the photosensitive body 101, the striking portions at four or more locations in total secured between the shafts located at front and rear positions contact to the same circumferential surface of the photosensitive body, and therefore, if pressing force is weak, at least one striking roller comes to have a gap with the photosensitive body 101. That is, the gap between the photosensitive body 101 and the developing sleeve 111 becomes larger than the desired amount, so that image defects such as scattering, blooming and the like may occur.

Conversely, if the pressing force is high, the developing container or the developing sleeve 111 may be subject to stressing, and it is impossible to guarantee main gaps. Moreover, this may disturb rotation of the photosensitive body and the developing sleeve 111, and also may grind the striking rollers 121*a*, 121*b* during the use. Because the gap between the photosensitive body 101 and the developing sleeve 111 decreases more than the desired amount, image defects such as blurring may occur.

In the second conventional example in which another developing sleeve 111*b* is rotatively supported via the rocking members 141 and in which the rocking members 141 are pushed to the photosensitive body 101 by the elastic member 151, there raise the following problems.

The gap between the developing sleeve 111*a* secured to the developing apparatus 109 and the photosensitive body 101, as well as the gap between the another developing sleeve 111*b* supported via the rocking members 141 and the photosensitive body 101 are guaranteed, and the axial centers at the ends of the respective developing sleeves 111*a*, 111*b* are guaranteed.

However, fundamental lines of the respective developing sleeves 111*a*, 111*b* may be shifted since the photosensitive body 101 is hit at the four points in the same way as in the first conventional example in which the developing container is secured, as described above, or namely, the gap between the developing upper sleeve 111*a* and the developing lower sleeve 111*b* becomes uneven in the axial longitudinal direction, so that unevenness in toner coating formed on the respective developing sleeves 111*a*, 111*b* may cause image defects.

Furthermore, in this conventional example, a magnetic sealing member is secured to the developing container to prevent the toner from leaking out of the end of the developing sleeve 111, and the gap between the developing sleeve 111*b* on the side supported at the shaft thereof via the rocking member 141 and the magnetic sealing member may vary depending on the vibrations of the photosensitive body 101. That is, there raises a problem that the developing sleeve rotation load torque increases due to toner leakage from the widen gap or due to toner adherence from the reduced gap.

SUMMARY OF THE INVENTION

It is an object of the invention to provide a developing apparatus providing a stable developing property not increasing rotational load of a developing member.

It is another object of the invention to provide a developing apparatus not increasing rotational load of a developing member as preventing the developing property from lowering.

Further objects of the invention are apparent upon reading the following detailed description in reference to the drawings.

DETAILED DESCRIPTION OF THE PREFERRED EMBODIMENTS

Figure 5:
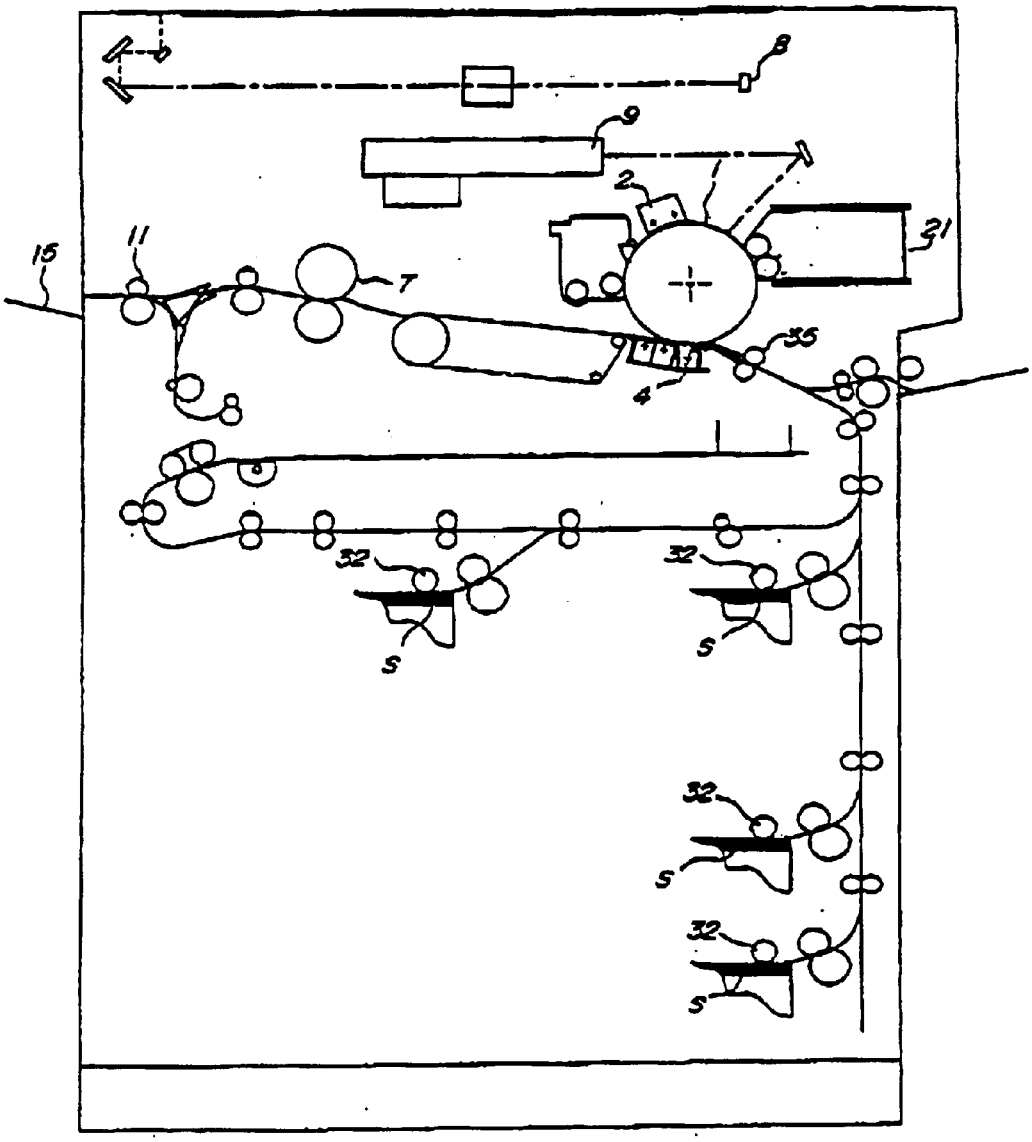
FIG. 5 is a schematic cross section showing an outlined structure of an image forming apparatus.

Referring to the drawings, a developing apparatus and an image forming apparatus having this developing apparatus as embodiments according to the invention are described. FIG. 5 is a schematic cross section showing an outlined structure of an image forming apparatus.

As shown in FIG. 5, an image forming apparatus according to this embodiment reads images on an original document at an image reading section 8 and forms electrostatic latent images on a photosensitive drum 1 as a latent image carrier by rendering exposure from an image writing section 9 on a surface of the photosensitive drum 1 according to commands from a controller, not shown, based on the read image data.

It is to be noted that where the surface of the photosensitive drum 1 is charged uniformly at a prescribed potential by a charger 2 before the exposure, the electrostatic latent image is formed on the photosensitive drum 1 by radiating laser beam or the like from the image writing section 9 on the photosensitive drum uniformly charged. The electrostatic latent image formed on the photosensitive drum 1 is developed in application of a toner as a developing agent with a developing apparatus 21. A developing bias voltage in which an AC voltage is overlapped to a DC voltage is given to a developing upper sleeve and a developing lower sleeve during the development. The developed toner images are then conveyed to a facing section for facing to a transfer apparatus 4 according to rotation of the photosensitive drum 1.

In response to the conveyance of the developed toner images, the sheet S as a recording medium is fed sheet by sheet out of a sheet cassette by a pickup roller 32, and the sheet S is conveyed to the facing section between the photosensitive drum 1 and the transfer apparatus 4 with a proper timing made by a registration roller pair 35. When the sheet S passes the facing section between the photosensitive drum 1 and the transfer apparatus 4, the toner images developed on the photosensitive drum 1 are transferred onto the sheet S by the transfer apparatus 4.

The sheet S to which the toner images are transferred is conveyed to a position of a fixing roller pair 7 by a prescribed conveyance apparatus and pressed by the fixing roller pair 7, and the toner on the sheet S is melted and fixed to the sheet S in application of heat from a heater, not shown, formed in the fixing roller. The sheet S to which the toner images are fixed is then contained in a tray 15 located at the exterior of the apparatus housing by a delivery roller 11, thereby finishing a series of image forming processes.

Developing Apparatus

Next, the developing apparatus 21 is described. Described above is that a developing apparatus in which plural developing sleeves as developing rotational carriers are disposed in the same developing container is required to guarantee gaps with high accuracy for each of the gap between the developing upper sleeve and the photosensitive body as an image carrier, the gap between the developing lower sleeve and the photosensitive body, and the gap between the developing upper sleeve and the developing lower sleeve.

However, the followings are turned out as a result of a confirmation experiment with images with respect to line width, blooming index, scattering index, and the like where the gaps between the photosensitive body and the respective developing upper and lower sleeves are varied.

Figure 6:
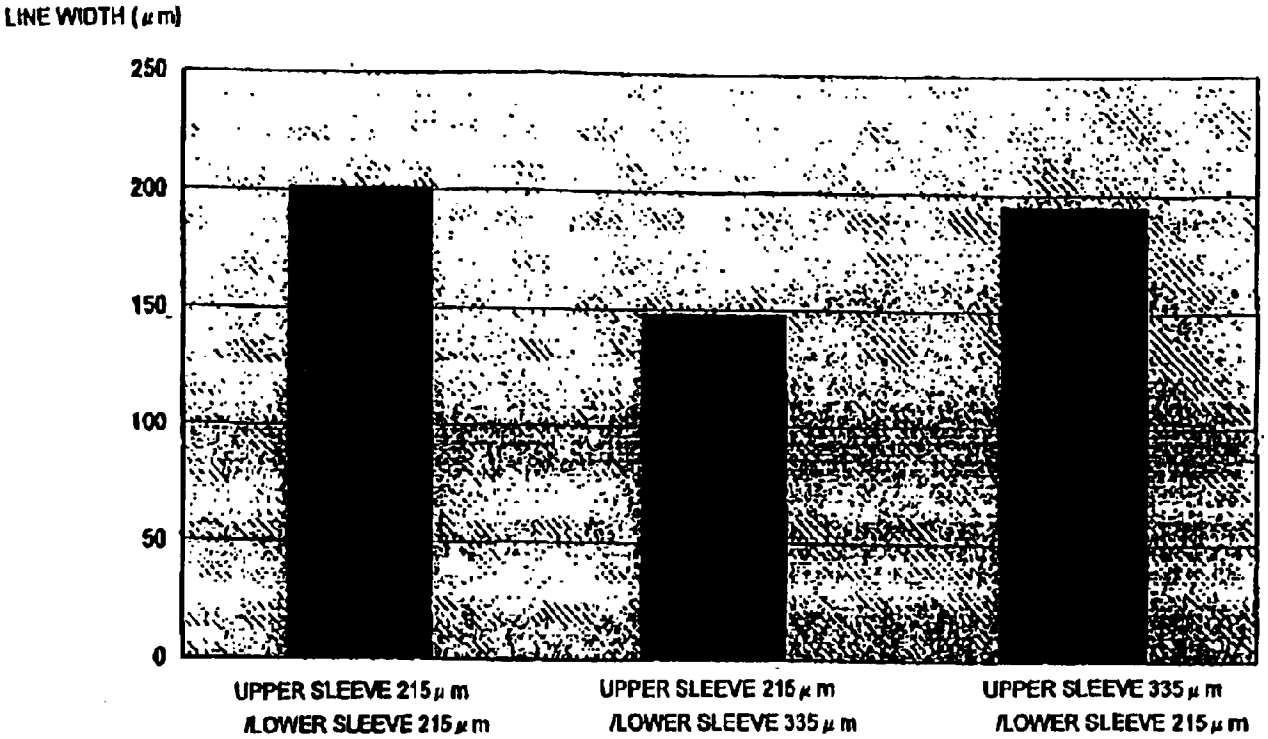
FIG. 6 is a graph showing experimental data indicating line width where the gaps between the photosensitive body and the respective developing sleeves are varied.

FIG. 6 is a graph indicating line width where the gaps between the photosensitive body and the respective developing sleeves are varied. It turns out that where the gap between the developing lower sleeve and the photosensitive body becomes wider, the line width becomes fine, but where the gap between the developing upper sleeve and the photosensitive body is widened, this hardly affects the width.

Figure 7:
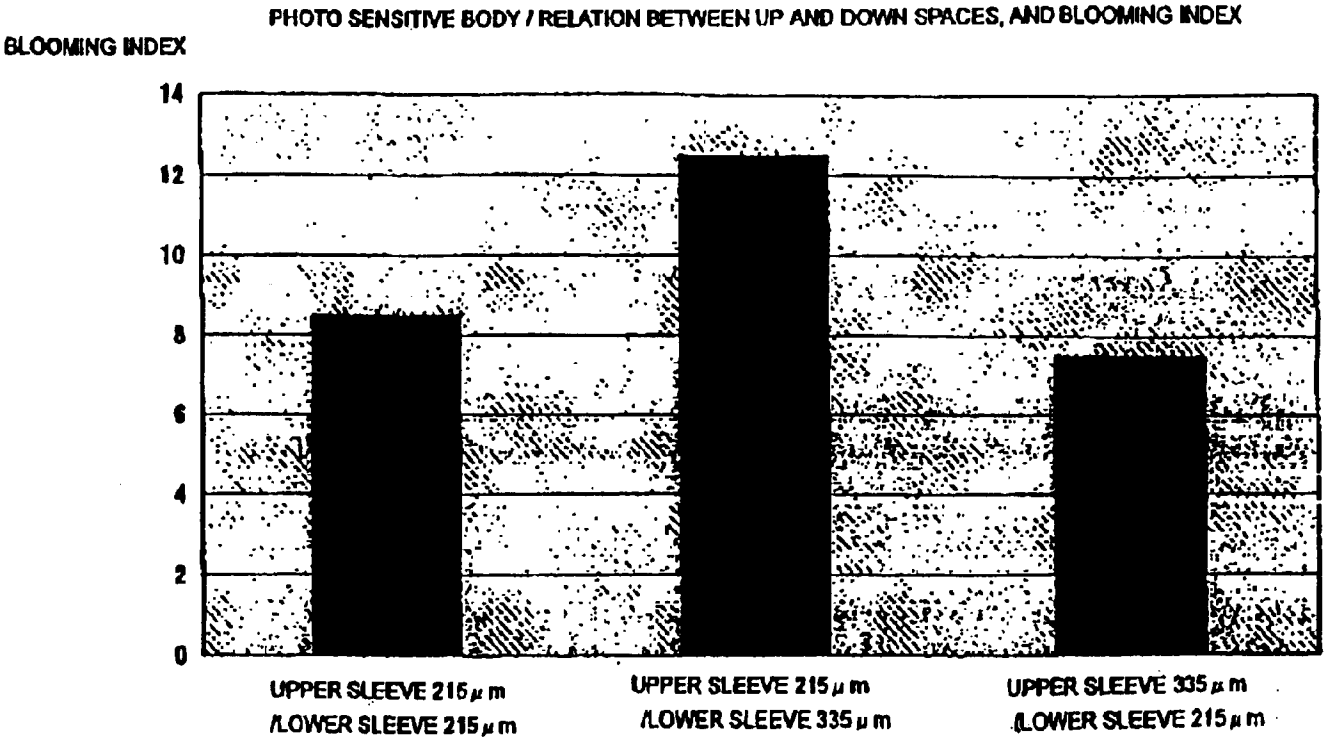
FIG. 7 is a graph showing experimental data indicating blooming index where the gaps between the photosensitive body and the respective developing sleeves are varied.

FIG. 7 is a graph indicating blooming index where the gaps between the photosensitive body and the respective developing sleeves are varied. The image blooming level becomes worse as the blooming index becomes larger. With this experimental result, it turns out that where the gap between the developing lower sleeve and the photosensitive body becomes wider, the blooming index becomes worse, but where the gap between the developing upper sleeve and the photosensitive body is widened, this hardly affects the index.

Figure 8:
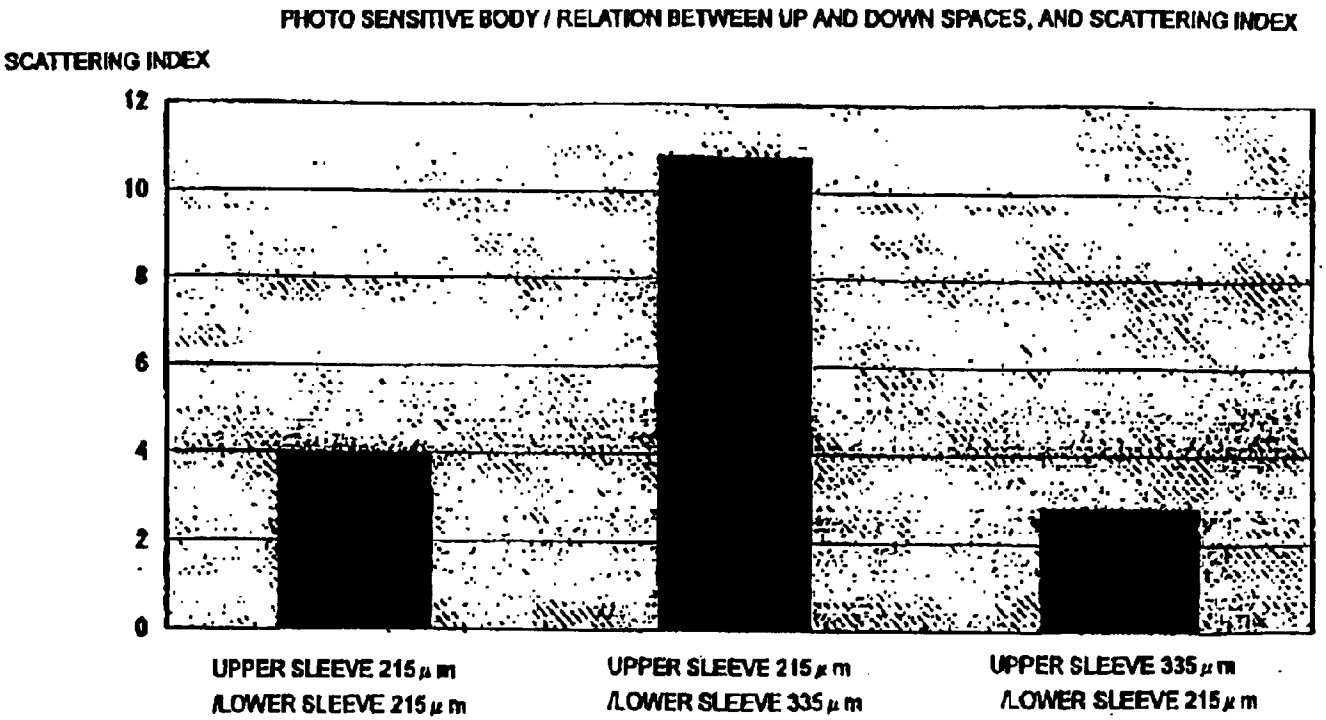
FIG. 8 is a graph showing experimental data indicating scattering index where the gaps between the photosensitive body and the respective developing sleeves are varied.
Figure 9:
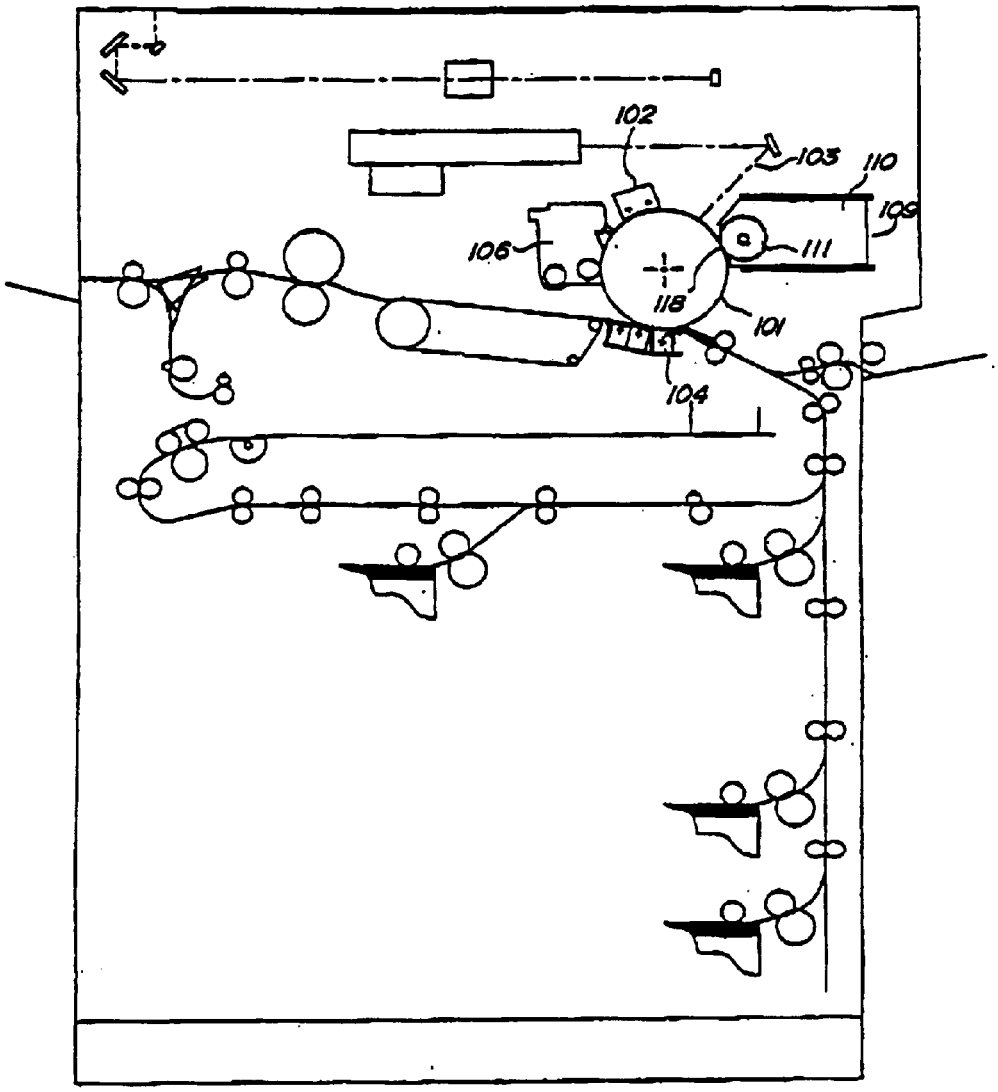
FIG. 9 is a schematic cross section showing an outlined structure of a conventional image forming apparatus.
Figure 10:
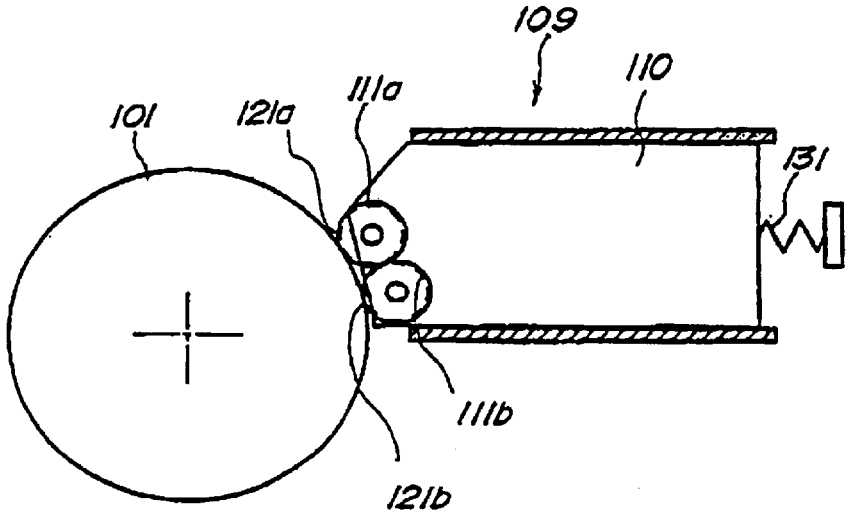
FIG. 10 is a schematic cross section showing a developing apparatus as a first conventional example having two developing sleeves.
Figure 11:
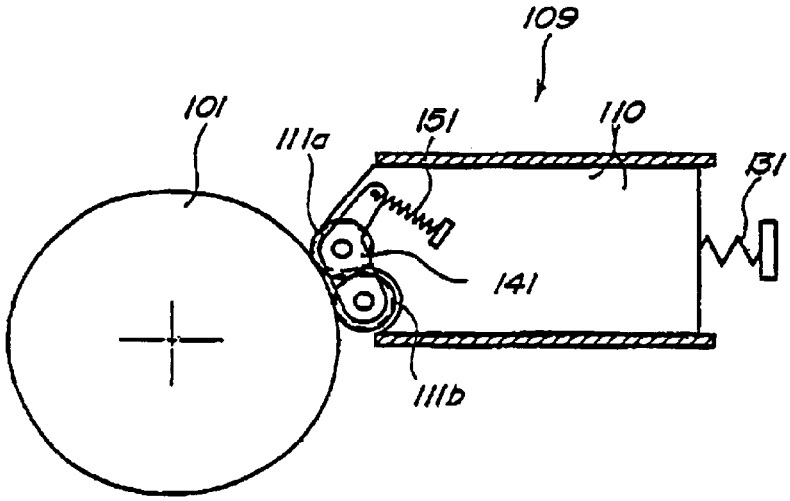
FIG. 11 is a schematic cross section showing a developing apparatus as a second conventional example having two developing sleeves.

FIG. 8 is a graph indicating scattering index where the gaps between the photosensitive body and the respective developing sleeves are varied. The image scattering level becomes worse as the scattering index becomes larger. With this experimental result, it turns out that where the gap between the developing lower sleeve and the photosensitive body becomes wider, the scattering index becomes worse, but where the gap between the developing upper sleeve and the photosensitive body is widened, this hardly affects the index.

That is, the obtained results were that even where the gap between the developing upper sleeve and the photosensitive body is not guaranteed with high accuracy, the images are hardly affected, but the gap between the developing lower sleeve and the photosensitive body is important.

In a meanwhile, the gap between the developing upper sleeve and the developing lower sleeve is important, and from the past experimental results, problems that if the gap is 0.4 mm or less, the triboelectric property of the toner coated on a sleeve surface is reduced to invite a thinner image density whereas if the gap is 0.6 mm or more, the toner coating on the sleeve surface becomes uneven thereby causing image defects, are apparent.

Figure 1:
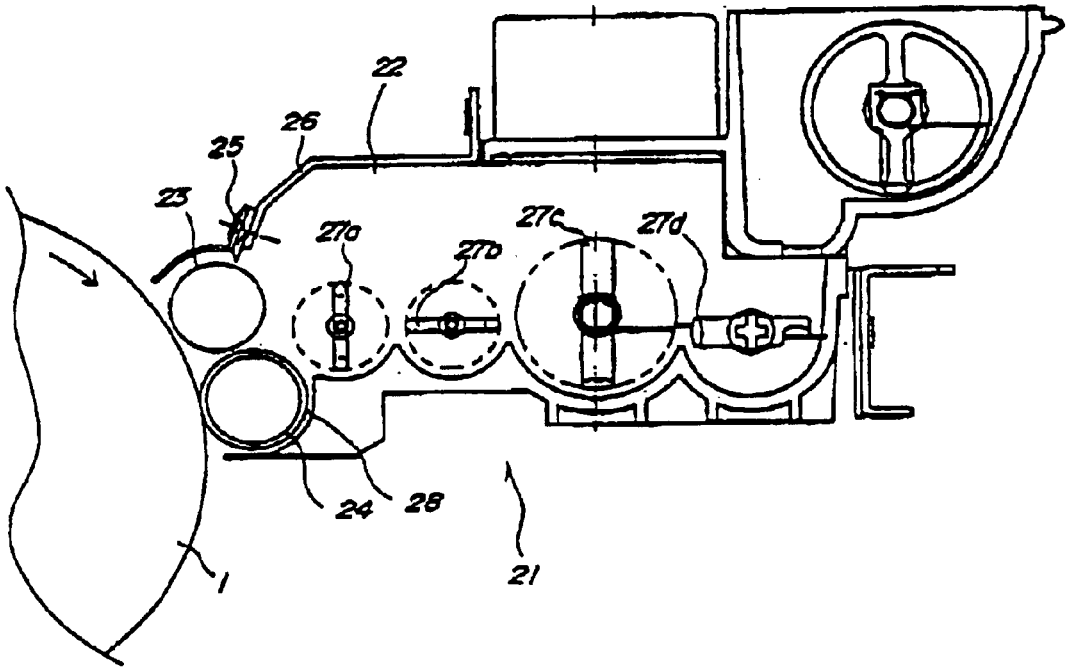
FIG. 1 is a schematic diagram showing a developing apparatus.

The developing apparatus 21 is therefore structured as follows. FIG. 1 is a schematic cross section of the developing apparatus. The developing apparatus 21 is formed with a developing upper sleeve 23 as a first developing member and a developing lower sleeve 24 as a second developing member on a side of the photosensitive drum 1 in the developing container 22 for containing the developing agent. It is to be noted that the developing upper sleeve 23 and the developing lower sleeve 24 are, in this order, structured to develop common electrostatic images formed on the photosensitive drum 1.

The developing upper sleeve 23 has a magnet inside and is rotatively supported to the developing container 22. The developing lower sleeve 24 has a magnet inside in substantially the same manner as the developing upper sleeve 24 and is rotatively supported to the developing container 22. The developing upper sleeve 23 and the developing lower sleeve 24 are arranged adjacently to each other upon positioning via bearings with fitting holes reference formed in the side wall of the developing container 22 so that the facing gap between the developing upper sleeve 23 and the developing lower sleeve 24 is 0.4 to 0.6 mm.

A holding member 26 secured to the developing container 22, and a developing agent restricting blade 25 held at the holding member 26 are formed above the developing upper sleeve 23. A striking roller 28 as a keeping member for guaranteeing the gap between the developing lower sleeve 24 and the photosensitive drum 1 in contact with the circumferential surface of the photosensitive drum 1 is formed on each end in the longitudinal direction on the shaft of the developing lower sleeve 24.

Stirring members 27*a*, 27*b*, 27*c*, 27*d* are formed for stirring the developing agent in the container inside the developing container 22 and for conveying the developing agent toward the developing sleeve.

Figure 2:
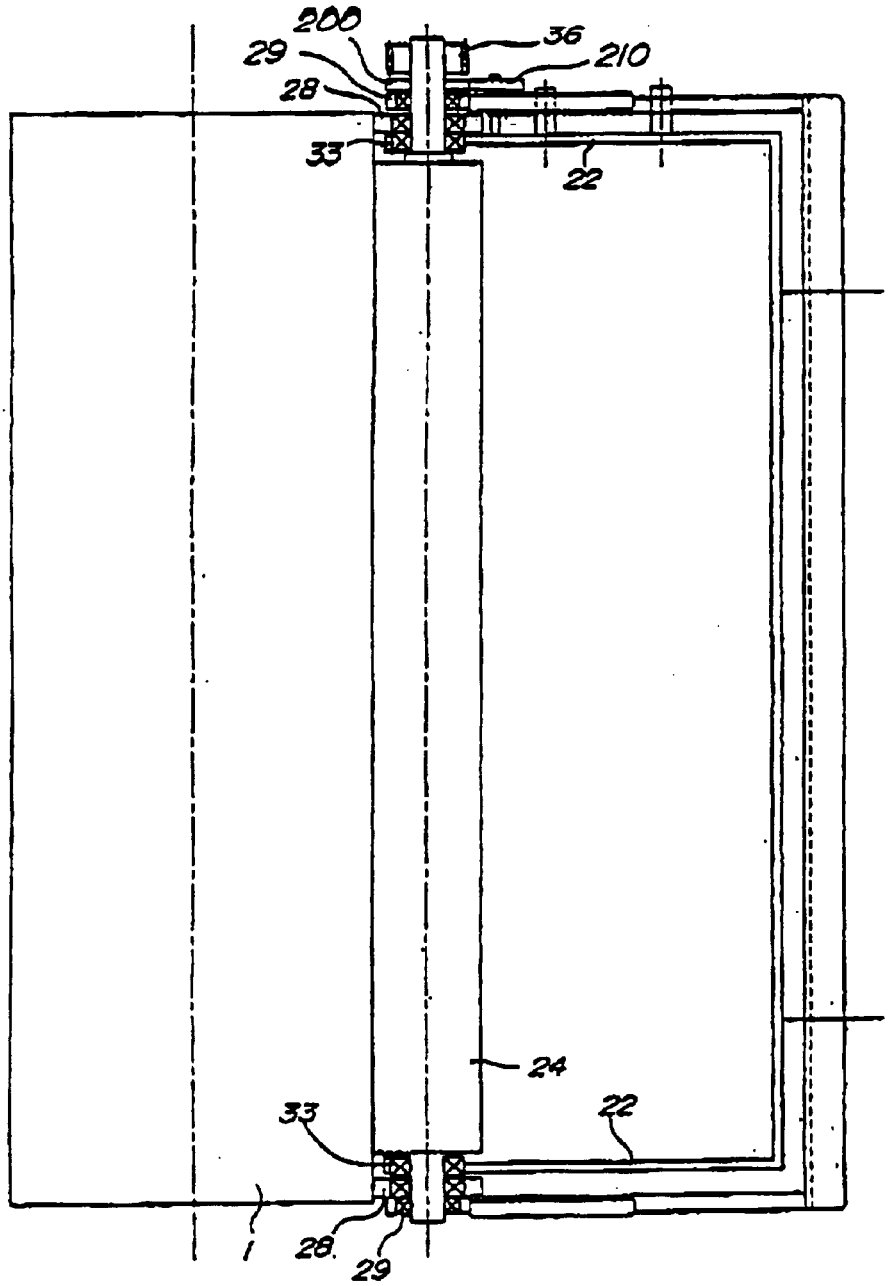
FIG. 2 is a cross section showing a developing lower sleeve when cut in an axial direction thereof.

FIG. 2 is a cross section showing the developing lower sleeve 24 when cut in an axial direction thereof. Bearings 33, the striking rollers 28, and pressing rollers 29 are provided on the shaft of the developing lower sleeve 24.

The developing lower sleeve 24 is rotatively supported to the side wall of the developing container 22 by bearings 33 on each side and supports rotatably at the shaft thereof the striking roller 28 for restricting the gap with the photosensitive drum 1. The pressing roller 29 receives pressure from a pressing means mounted in the housing described below when the developing apparatus 21 is attached inside the image forming apparatus body. A rotary drive inputting gear 36 receives a drive force from the input gear on the side of the image forming apparatus body, not shown, and transmits the rotary drive to the developing lower sleeve 24.

Figure 3:
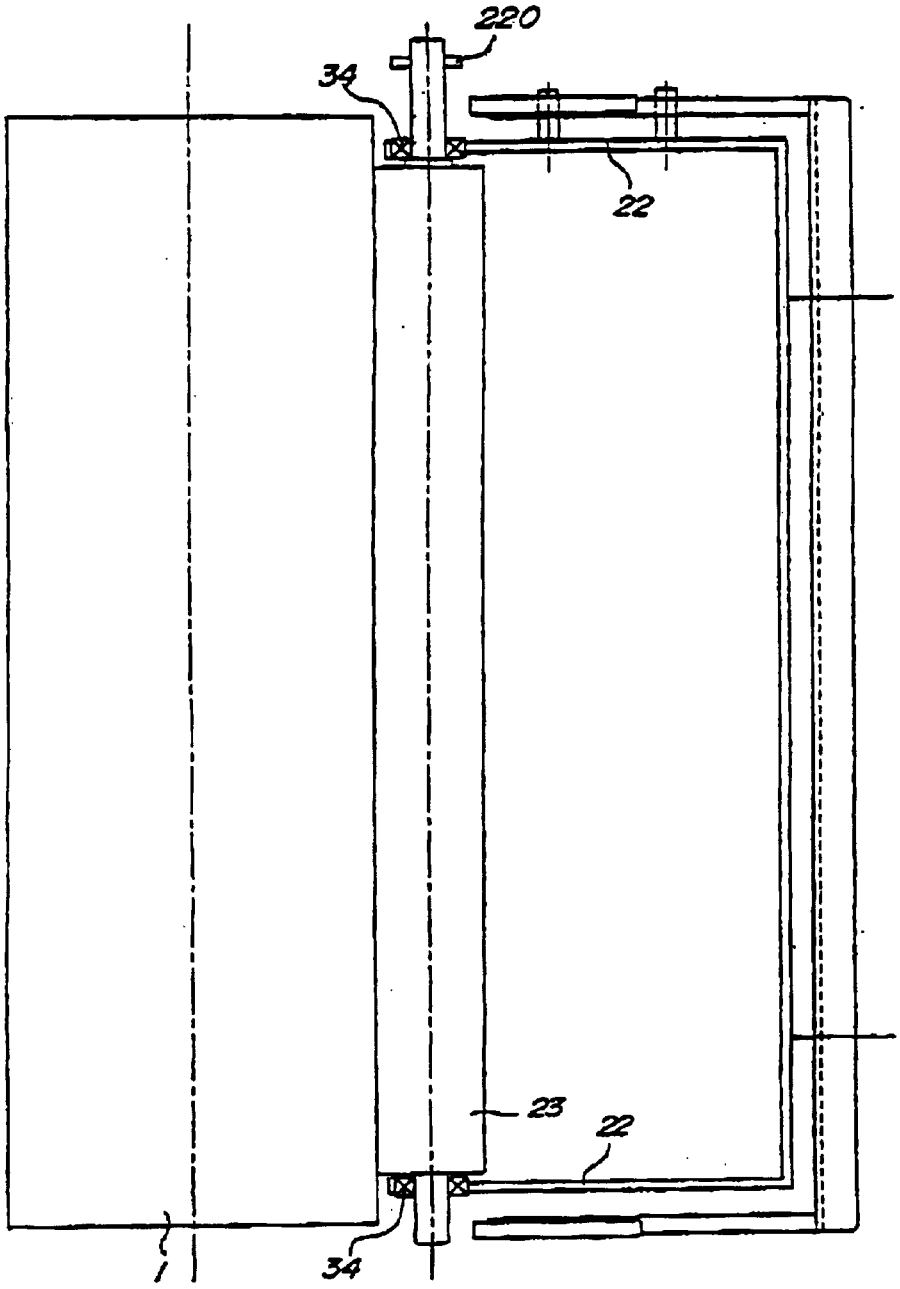
FIG. 3 is a cross section showing a developing upper sleeve when cut in an axial direction thereof.

FIG. 3 is a cross section showing a developing upper sleeve 23 when cut in an axial direction thereof. The developing upper sleeve 23 is rotatively supported to the side wall of the developing container 22 by bearings 34 on each side in substantially the same manner as the developing lower sleeve 24.

The rotation of the developing upper sleeve 23 is given as a drive to a gear 220 (see, FIG. 3) on a rotary shaft of the developing upper sleeve 23 via an idler gear 210 (see, FIG. 2) rotatably supported to the side wall of the developing container 22 from a gear 200 (see, FIG. 2) on the rotary shaft of the developing lower sleeve 24, and the rotational drive of the developing lower sleeve 24 is transmitted to the developing upper sleeve 23.

Alternatively, the drive may be transmitted from a pulley, not shown, on the rotary shaft of the developing lower sleeve 24 to a pulley, not shown, on the rotary shaft of the developing upper sleeve 23 via directly a timing belt, thereby transmitting the rotational drive to the developing upper sleeve 23.

Figure 4:
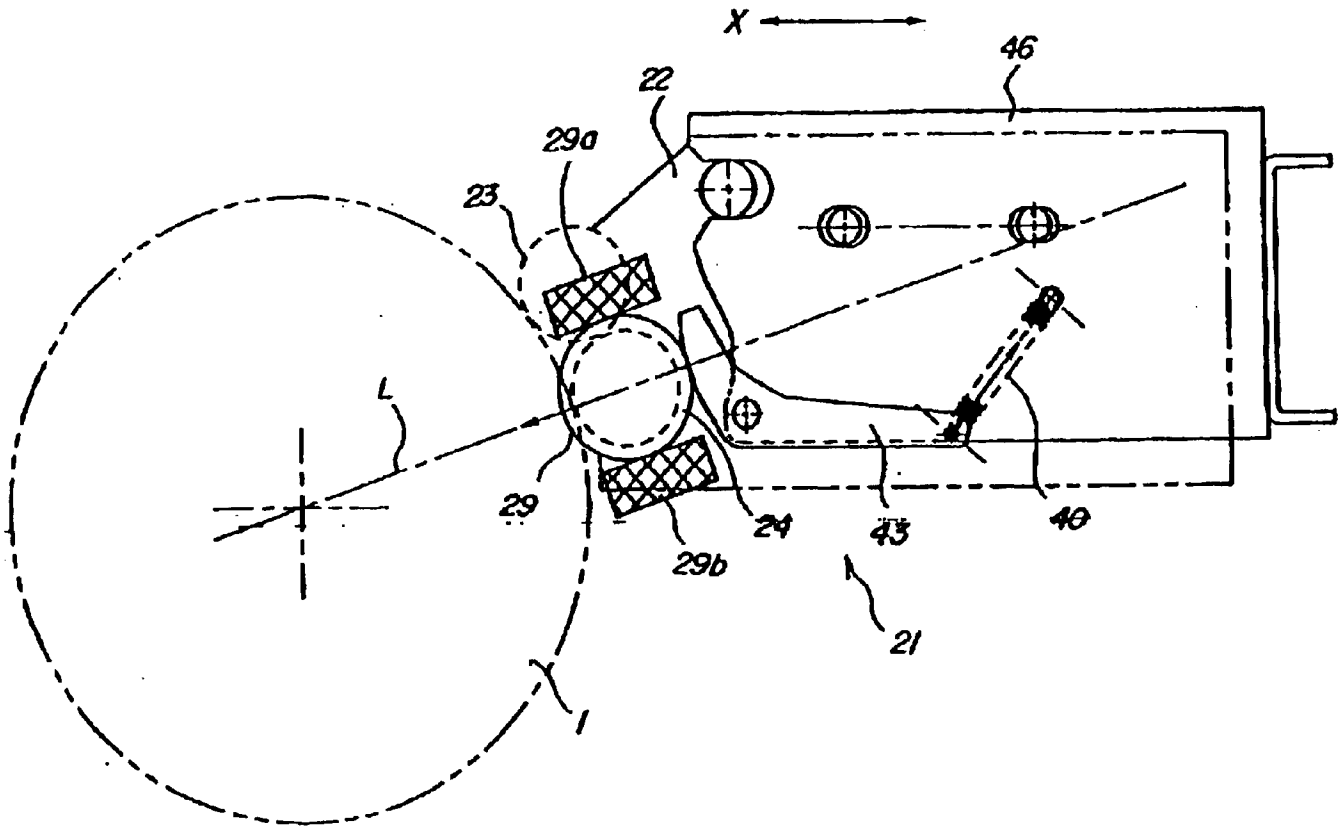
FIG. 4 is a diagram showing a pressing means of the developing apparatus.

FIG. 4 is a side view showing the developing apparatus 21 and is a view describing the pressing means of the developing apparatus 21. The pressing roller 29 as a pressing means of one of a pair is provided on each end of the developing lower sleeve 24 so as to be coaxial to the rotary shaft of the developing lower sleeve 24. Each of the two pressing rollers 29 is formed with a guide member 29*a*, 29*b* for the pair of the pressing rollers 29, each having a parallel plane to a straight line L coupling the rotational center of the developing lower sleeve 24 with the rotational center of the photosensitive drum 1, and being disposed as that the parallel plane to the straight line L is in contact with the outer circumference of the pressing roller 29. The pressing roller 29 moves only in a direction along the straight line L according to the guide members 29*a*, 29*b*.

The pressing means is provided including two pressing plates 46 secured to the image forming apparatus body for holding each end of the developing container 22, and a pressing arm 43 rotatively supported to the pressing plate 46 serving as a pressing portion capable of pressing the pressing roller 29 toward the photosensitive drum 1 along the straight line L according to an elastic member 40 such as a spring. With this pressing means, each end of the developing lower sleeve 24 is pushed down only in a direction toward the photosensitive drum 1 via the two pressing rollers 29. In this pressing operation, the developing container (shown with a broken line in FIG. 4) is moved forward in an X direction, and a correlative position of the developing container to the image forming apparatus body is also determined by restriction at projections against the forward movement with respect to long holes formed in the pressing plates.

When the pressure thus made is applied, the photosensitive drum 1 and the developing lower sleeve 24 are disposed in keeping a prescribed SD gap by contacting the outer periphery of the striking rollers 28 with the outer periphery of the photosensitive drum 1 in association with the striking rollers 28 serving as two striking members formed larger by a portion of the SD gap than the outer diameter of the developing lower sleeve 24. The two striking rollers 28 are formed via the bearings 33 to the developing lower sleeve 24, thereby not preventing the photosensitive drum 1 and the developing lower sleeve 24 both from rotating.

As apparent from the plane view in FIG. 2, the SD gap is guaranteed upon hitting the striking rollers 28 to each end of the photosensitive drum 1. It is to be noted that the position that the striking roller 28 strikes is at each end in the longitudinal direction of the photosensitive drum 1 in substantially the same manner as the prior art.

As described above, the developing apparatus can be positioned well by contacting the striking rollers located at the two locations to a circumferential surface of the photosensitive drum, so that the main gap between the developing lower sleeve 24 and the photosensitive drum 1 is surely guaranteed.

The main gap between the developing lower sleeve 24 and the developing upper sleeve 23 is surely guaranteed without urging force to the developing apparatus 22 more than the necessary one, and furthermore, the striking roller 28 is prevented from being ground.

The position of the developing lower sleeve 24 is determined with high accuracy with respect to the image forming apparatus body even where the position of the developing apparatus 21 is varied to some extent. Therefore, image defects such as unevenness in gear's pitch caused by inaccuracy in distances among gears can be prevented The developing apparatus in which the plural developing sleeves are disposed within the same developing apparatus and the image forming apparatus can achieve high image quality with a simple structure, and can provide a stable developing feature without toner leakage or rotational load increase in the developing sleeves and photosensitive body.

As described above, the apparatus has a structure guaranteeing the gaps by forming the striking members, formed on the shaft of the developing agent carrier located at the most downstream position during the image forming process among the plural developing agent carriers, for keeping constant the distance between the developing agent carrier located at the most downstream position and the photosensitive body upon being coupled to the developing agent carrier so as to be rotatable and being in contact with the photosensitive body, by not forming the striking members for keeping constant the gap to the photosensitive body at the other developing agent carriers, and by disposing the bearing portions (hole portions) for supporting at the shaft of the other developing agent carriers to the side wall of the developing container with high accuracy.

With this structure, the developing apparatus can be positioned in contacting the peripheral surface of the photosensitive body with the striking rollers at two locations, thereby reducing the rotation load of the photosensitive body. The main gap between the developing lower sleeve and the photosensitive body is surely guaranteed to improve the developing property.

The fitting hole positions in the side walls of the developing apparatus for rotatably supporting the developing agent carrier at the shaft thereof, restrict the gap between the developing agent carrier located at the most downstream position during the image forming process and the other developing agent carrier. Therefore, the main gap between the developing upper sleeve and the developing lower sleeve is surely guaranteed, so that external disturbances generating stresses in the side walls of the developing container can be prevented.

The pressing member located on the same shaft line as the shaft line of the developing agent carrier located at the most downstream position during the image forming process is provided for pressing the developing agent carrier toward the photosensitive body. Therefore, the striking roller can be prevented from being ground without applying urging force more than the necessary force to the developing container, thereby surely guaranteeing the main gap between the developing lower sleeve and the photosensitive body.

The drive inputting gear located on the same shaft line as the shaft line of the developing agent carrier located at the most downstream position during the image forming process is provided for coupling to the developing agent carrier and transmitting drive to the developing agent carrier from the image forming apparatus body. Therefore, the position of the developing lower sleeve is determined with high accuracy with respect to the image forming apparatus body even where the position of the developing apparatus is varied to some extent. Therefore, image defects such as unevenness in gear's pitch caused by inaccuracy in distances among gears, increase of the rotational load torque of the developing sleeves due to toner leakage from an increased gap or due to toner adherence from a decreased gap can be prevented.

Furthermore, the image forming apparatus is formed with the pressing guide members extending substantially parallel to the straight line coupling the center of the striking member for the developing agent carrier located at the most downstream position in the image forming process with the center of the photosensitive body, and the pressing means for pushing the member to be pressed toward the direction of the photosensitive body along the pressing guide. Therefore, the image forming apparatus can efficiently utilize the developing apparatus in which the plural developing sleeves are arranged in the same developing container.

What is claimed is:

1. A developing apparatus comprising:

a developing container for containing a developing agent; and rotatable first and second developing members attached to the developing container so as to face an image carrier for developing an electrostatic image formed on the image carrier, wherein the first developing member is secured to the developing container so as to maintain a gap with respect to the image carrier;

wherein the second developing member includes keeping members at both ends in a longitudinal direction thereof, and wherein only the keeping members contact with the image carrier to maintain the gap between the first developing member and the image carrier, and a gap between the second developing member and the image carrier, respectively.

2. The developing apparatus according to claim 1, wherein the first developing member and the second developing member develop images in order on a common electrostatic image formed on the image carrier.

3. The developing apparatus according to claim 2, wherein the keeping members are provided rotatively with respect to the second developing member.

4. The developing apparatus according to claim 2, further comprising a transmission member for transmitting a rotational drive force received by the second developing member to the first developing member.

5. The developing apparatus according to claim 1 or 2, further comprising a pressing means for pressing the second developing member as determined by a restricting member toward the image carrier.

6. The developing apparatus according to claim 5, wherein the pressing means includes a structure to press via a rotatable pressing member arranged at each end in a longitudinal direction of the second developing member and presses substantially parallel to a straight line coupling a center of the pressing member and a center of the image carrier.

7. The developing apparatus according to claim 2, wherein the first and second developing members during a developing process are applied with a voltage in which a direct current voltage is overlapped with an alternating current voltage.

* * * * *

UNITED STATES PATENT AND TRADEMARK OFFICE

CERTIFICATE OF CORRECTION

PATENT NO. : 6,839,535 B2
DATED : January 4, 2005
INVENTOR(S) : Shinichi Sugiyama It is certified that error appears in the above-identified patent and that said Letters Patent is hereby corrected as shown below:

Title page,
Item [57], ABSTRACT,
Line 2, "comprisinga" should read -- comprising a --.

Column 2,
Line 15, "high" should read -- of high --; and "sleeve" should read -- sleeves, --;
Line 49, "raise" should read -- arise --; and
Line 52, "another" should read -- other --.

Column 3,
Line 10, "widen" should read -- widened --; and
Line 19, "as" should read -- as well as --.

Column 4,
Line 55, "followings are turned out as a result of" should read -- the following results are obtained from --.

Column 5,
Line 22, "In a meanwhile, the" should read -- The --;
Line 24, "that" should read -- become apparent, namely that --; and "defects, are apparent." should read -- defects. --; and
Line 48, "holes reference" should read -- reference holes --.

Column 6,
Line 43, "as" should read -- so --.

Signed and Sealed this

Twenty-fourth Day of May, 2005

JON W. DUDAS
*Director of the United States Patent and Trademark Office*